US008632351B2

(12) United States Patent
Wu

(10) Patent No.: US 8,632,351 B2
(45) Date of Patent: Jan. 21, 2014

(54) CABLE ASSEMBLY WITH A FLOATING CONNECTOR

(75) Inventor: Jerry Wu, Irvine, CA (US)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/528,731

(22) Filed: Jun. 20, 2012

(65) Prior Publication Data

US 2012/0329316 A1 Dec. 27, 2012

(30) Foreign Application Priority Data

Jun. 25, 2011 (CN) ..... 2011 1 0173278

(51) Int. Cl.
*H01R 13/64* (2006.01)

(52) U.S. Cl.
USPC ..... 439/248

(58) Field of Classification Search
USPC ..... 439/247, 248, 607.46, 95, 497
See application file for complete search history.

(56) References Cited

U.S. PATENT DOCUMENTS

| | | | | |
|---|---|---|---|---|
| 3,631,325 | A * | 12/1971 | Wenz | 361/705 |
| 5,443,403 | A * | 8/1995 | Weidler et al. | 439/701 |
| 5,454,734 | A * | 10/1995 | Eggert et al. | 439/578 |
| 5,513,995 | A * | 5/1996 | Kurotori et al. | 439/64 |
| 6,210,216 | B1 | 4/2001 | Tso-Chin et al. | |
| 6,671,180 | B2 * | 12/2003 | Le et al. | 361/726 |
| 7,033,222 | B2 * | 4/2006 | Kitamura | 439/630 |
| 7,192,304 | B2 * | 3/2007 | Weingart et al. | 439/541.5 |
| 8,011,961 | B2 * | 9/2011 | Liu et al. | 439/607.58 |
| 8,016,609 | B1 * | 9/2011 | Lin | 439/483 |
| 8,353,724 | B2 * | 1/2013 | Shi et al. | 439/625 |
| 8,430,692 | B2 * | 4/2013 | Peng et al. | 439/607.46 |
| 2012/0115359 | A1 * | 5/2012 | Ko et al. | 439/578 |
| 2012/0214326 | A1 * | 8/2012 | Ko et al. | 439/345 |

* cited by examiner

*Primary Examiner* — Neil Abrams
*Assistant Examiner* — Phuongchi T Nguyen
(74) *Attorney, Agent, or Firm* — Wei Te Chung; Ming Chieh Chang

(57) ABSTRACT

A cable assembly (100) comprises a first connector (1), a second connector (2), a housing shroud (3) positioning the first connector (1) and the second connector (2) and a cable (4) connecting with rear ends of the first and the second connectors (1, 2). The cable assembly (100) further comprises two resilient members (15) abutting against an outside of the first connector, a gap (30) is defined between the housing shroud (3) and the first connector (1) so that the first connector can float under a condition that the resilient member resists the first connector.

13 Claims, 8 Drawing Sheets

CABLE ASSEMBLY WITH A FLOATING CONNECTOR

BACKGROUND OF THE INVENTION

1. Field of the invention

The present invention generally relates to a cable assembly and more particularly to a cable assembly with a number of connectors arranged side by side. This application is further related to U.S. patent application Ser. No. 13/400,874 filed on Feb, 21, 2012 and entitled "CABLE CONNECTOR ASSEMBLY ADAPTED FOR POWER AND SIGNAL TRANSMITTING" and further related to U.S. patent application Ser. No. 13/290,152 filed on Nov. 7, 2011 and entitled "CABLE ASSEMBLY ADAPTED FOR POWER AND SIGNAL TRANSMITTING," which has the same assignee as the present invention.

2. Description of Related Art

U.S. Pat. issure No. 6,210,216 B1 issured on Apr. 3, 2001 discloses a cable assembly including two connectors arranged side by side, a shell for positioning the two connectors and a cable connecting with the two connectors. The shell defines two positioning grooves for positioning the two connectors. Each connector has a body portion retained in the positioning groove and a mating portion extending beyond the shell. The shell clamps a rear end of the mating portion to prevent the mating portion from rocking. The cable assembly use one common cable to connect with the two connectors instead of using different cables which may trouble the user. However, a distance between the two mating portions of the two connectors and a distance between two mating plugs mating with the two connectors should be very precise. Otherwise, the cable assembly would not work normally.

It is thus desired to provide a improved cable assembly to solve the fault of the pri art.

SUMMARY OF THE INVENTION

An objector of the invention is to provide a cable assembly with a number of connectors arranged in a row.

According to one aspect of the present invention provides a cable assembly comprising a first connector, a second connector, a housing shroud positioning the first connector and the second connector and a cable connecting with back ends of the first and the second connectors, wherein the cable assembly further comprises a resilient member, a gap being defined between the housing shroud and the first connector for the first connector to float.

Other objects, advantages and novel features of the present invention will become more apparent from the following detailed description of the present embodiment when taken in conjunction with the accompanying drawings.

DETAILED DESCRIPTION OF THE INVENTION

Figure 1:
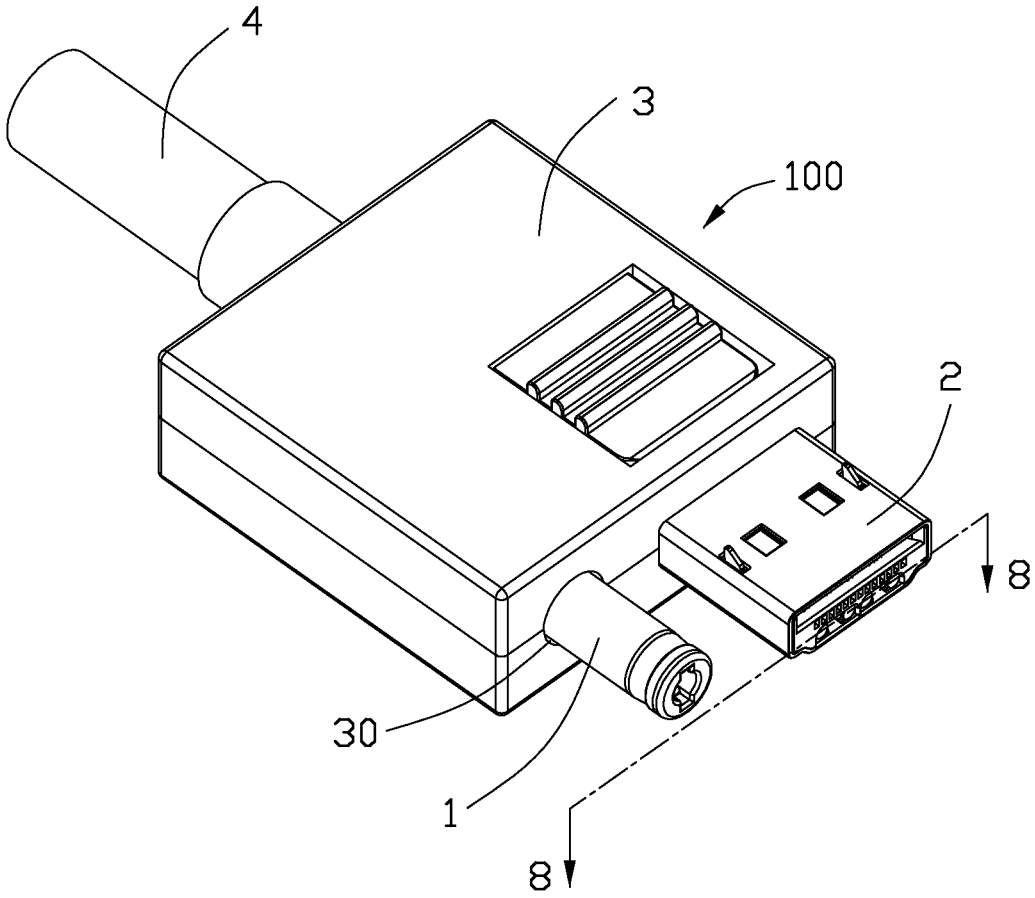
FIG. 1 is an assembled perspective view of a cable assembly according to a preferred embodiment of the present invention.

Reference will now be made to the drawing figures to describe the preferred embodiment of the present invention in detail.

Referring to FIGS. 1-8, the cable assembly 100 includes a first connector 1, a second connector 2, a housing shroud 3 for positioning the first connector 1 and the second connector 2 and a cable 4 connecting with two ends of the first and the second connectors. The first connector 1 and the second connector 2 are arranged side by side and fixed to the housing shroud 3.

Figure 2:
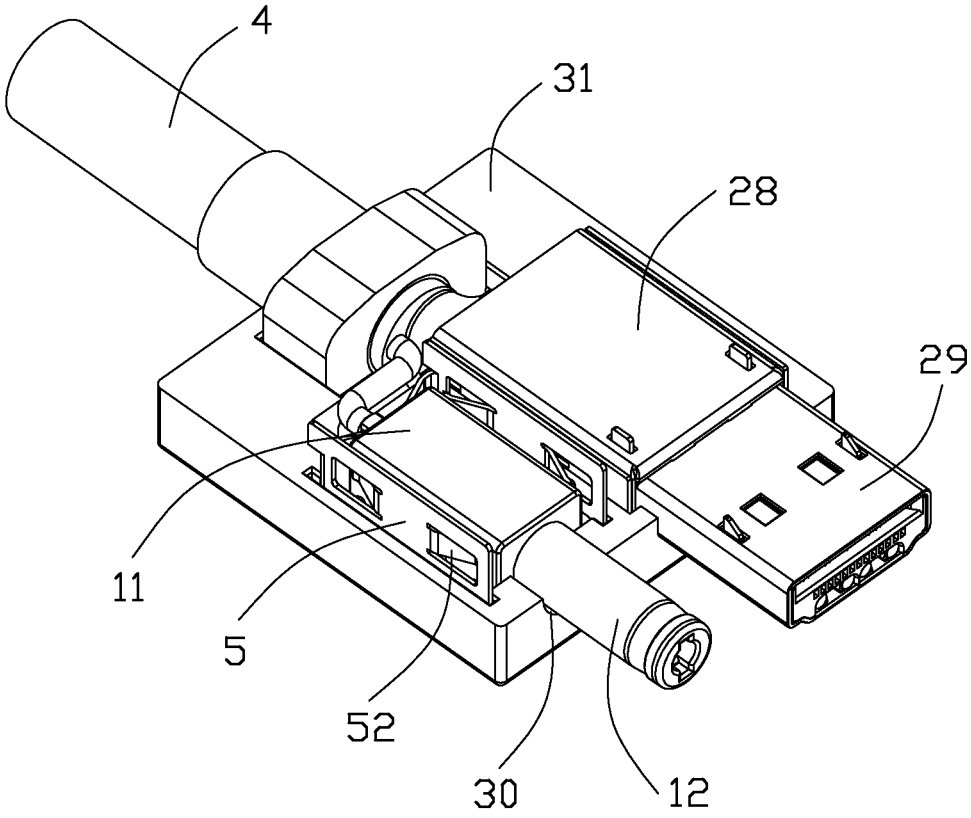
FIG. 2 is an assembled perspective view of the cable assembly with the a housing shroud removed from thereof.
Figure 3:
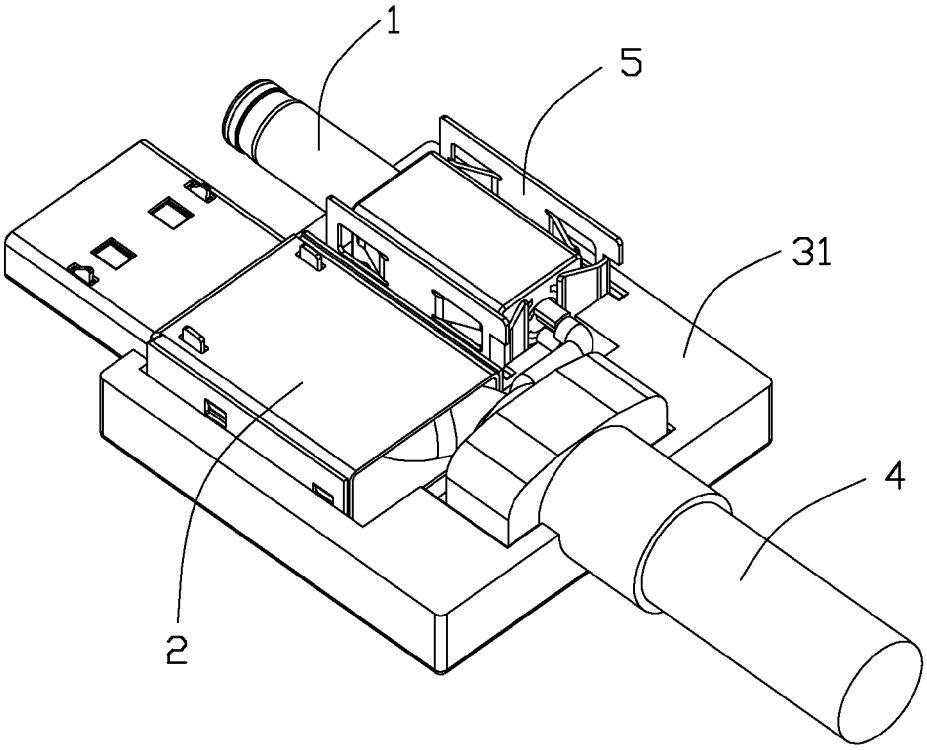
FIG. 3 is another assembled perspective view of the cable assembly as shown in FIG. 2 taken from another view.
Figure 6:
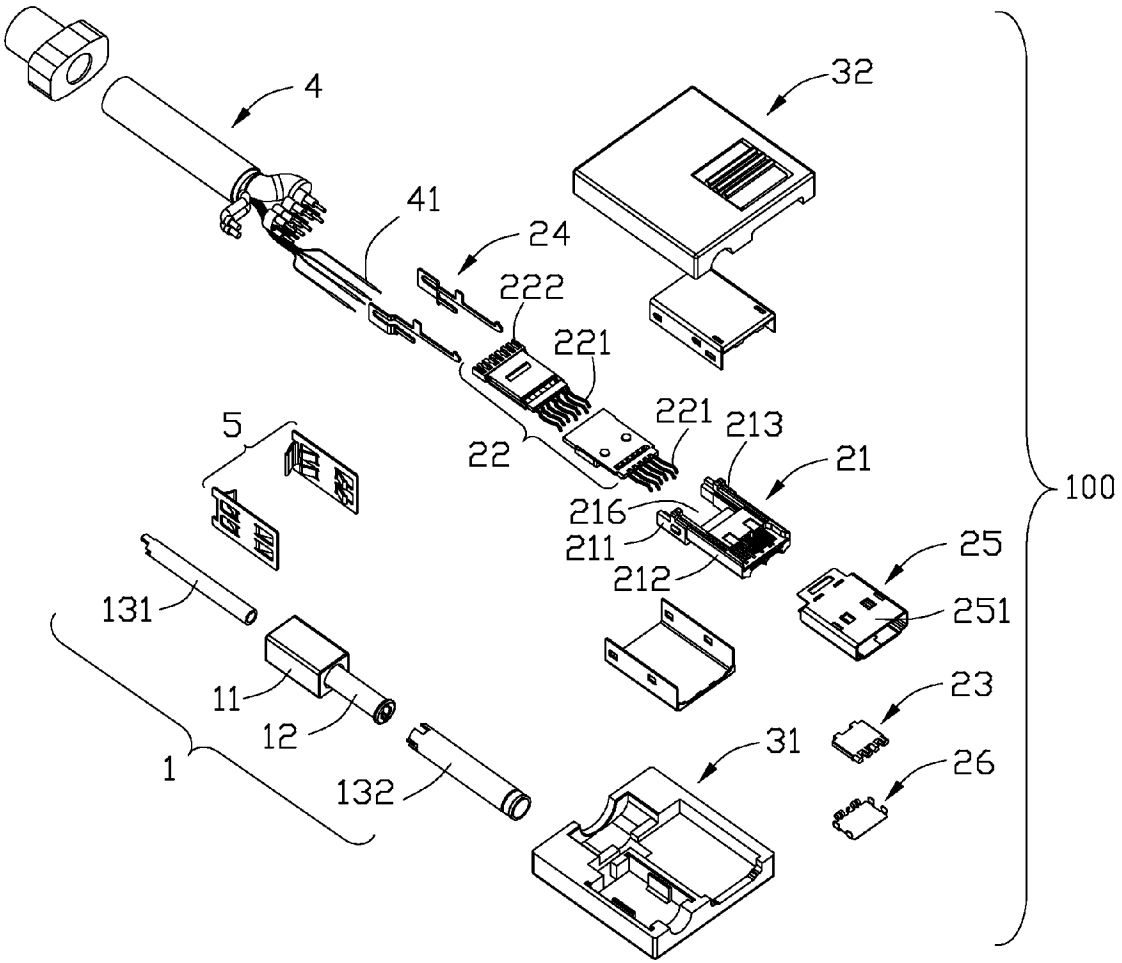
FIG. 6 is an exploded perspective view of the cable assembly.
Figure 7:
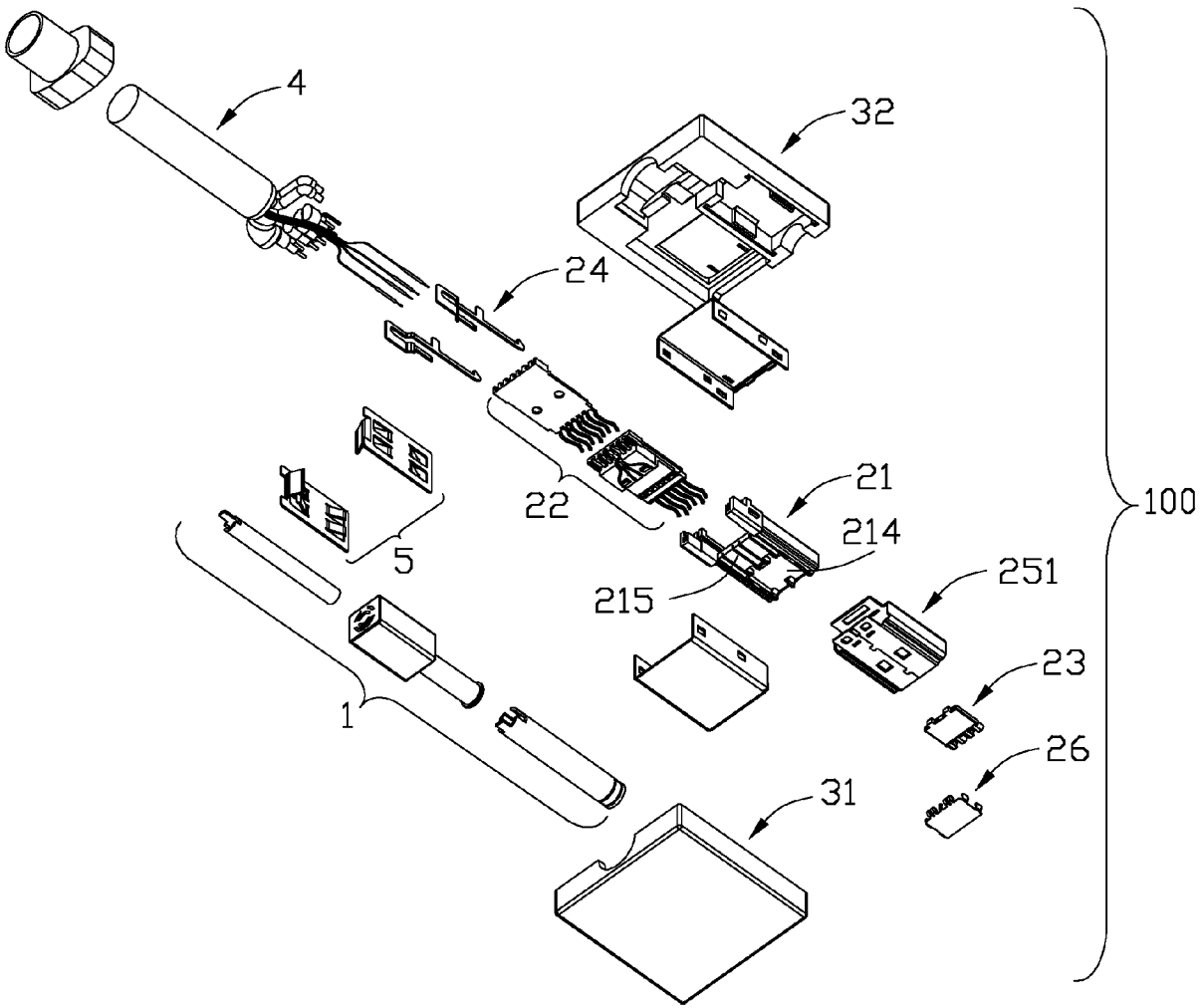
FIG. 7 is similar view to FIG. 6, while taken from a different aspect.
Figure 8:
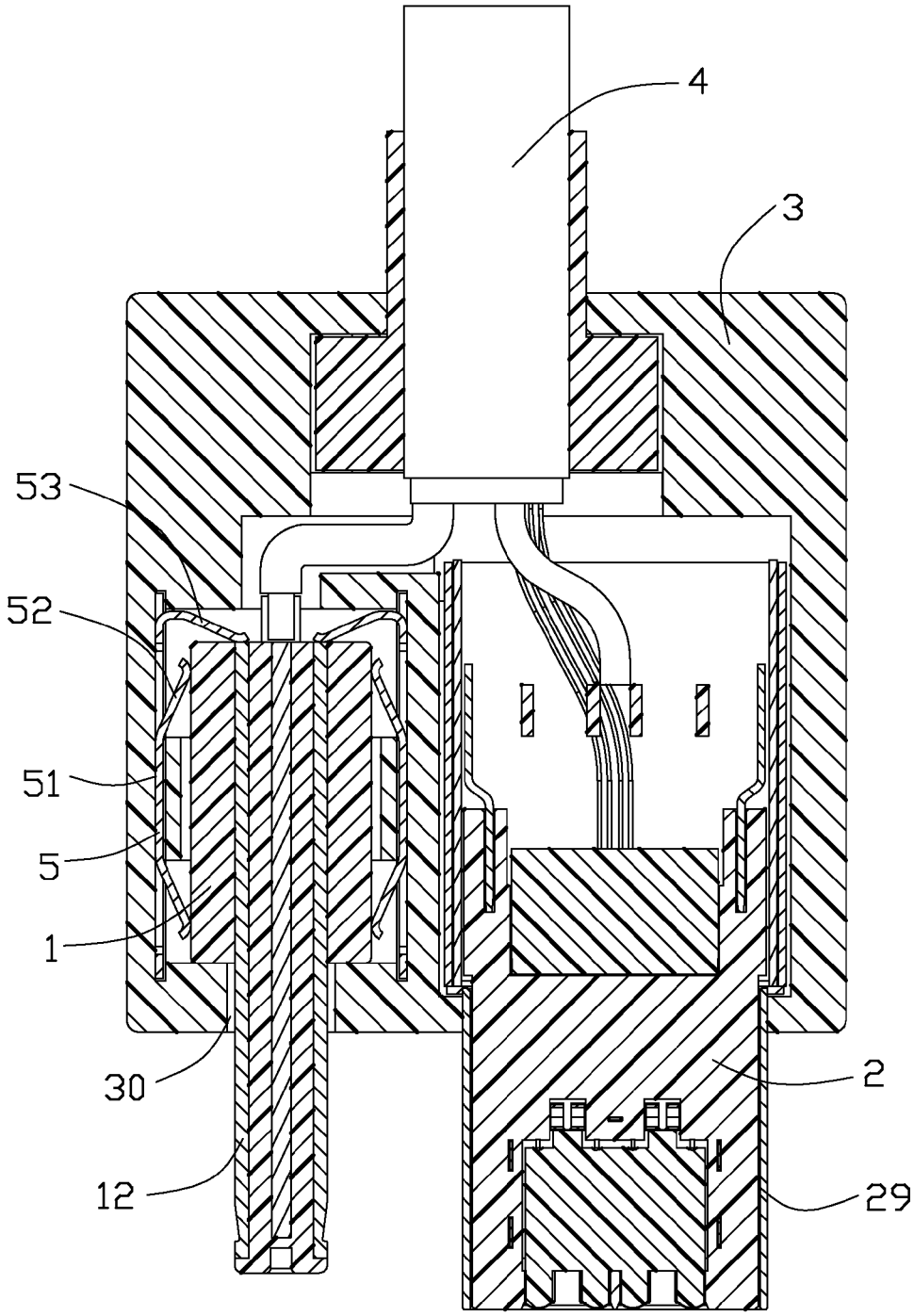
FIG. 8 is a cross-sectional view of the cable assembly taken along line 8-8 of FIG. 1.

Referring to FIGS. 2 and 6, the first connector is a power connector, in present embodiment, the power connector is a DC connector (DC Plug) for transmitting DC. The first connector 1 has a first body 11, a first mating portion 12 protruding beyond the housing shroud 3 to mate with a first mating connector(not shown). The first mating portion 12 is configuration as a column extending along a front-to-back direction. The first mating portion 12 also can be formed in a square, oval and so on. The first connector has a pair of contacts 131,132 located inside and outside of the first mating portion 12 respectively for transmitting the Positive and Negative current.

Figure 4:
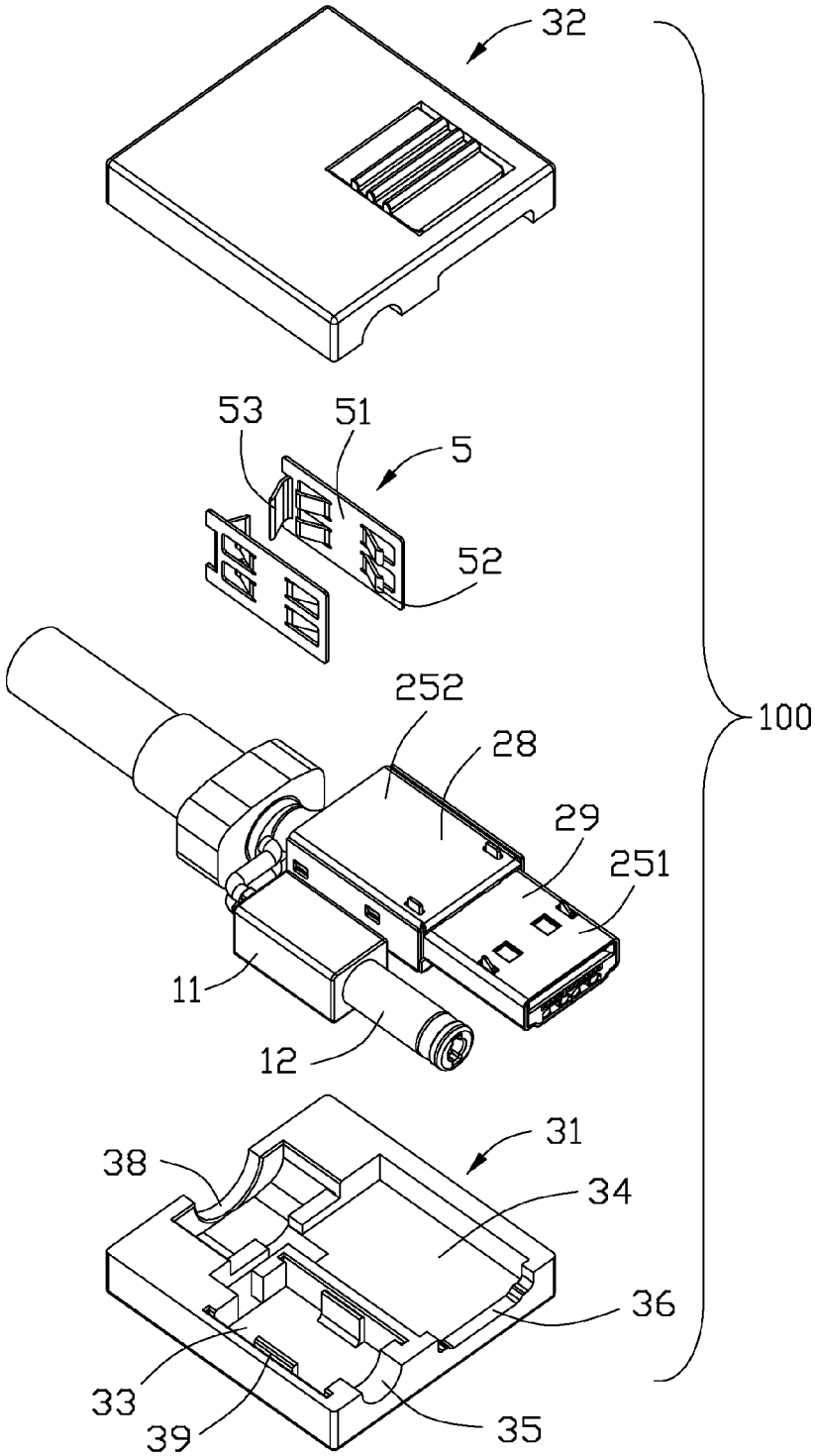
FIG. 4 is a partly exploded view of the cable assembly.
Figure 5:
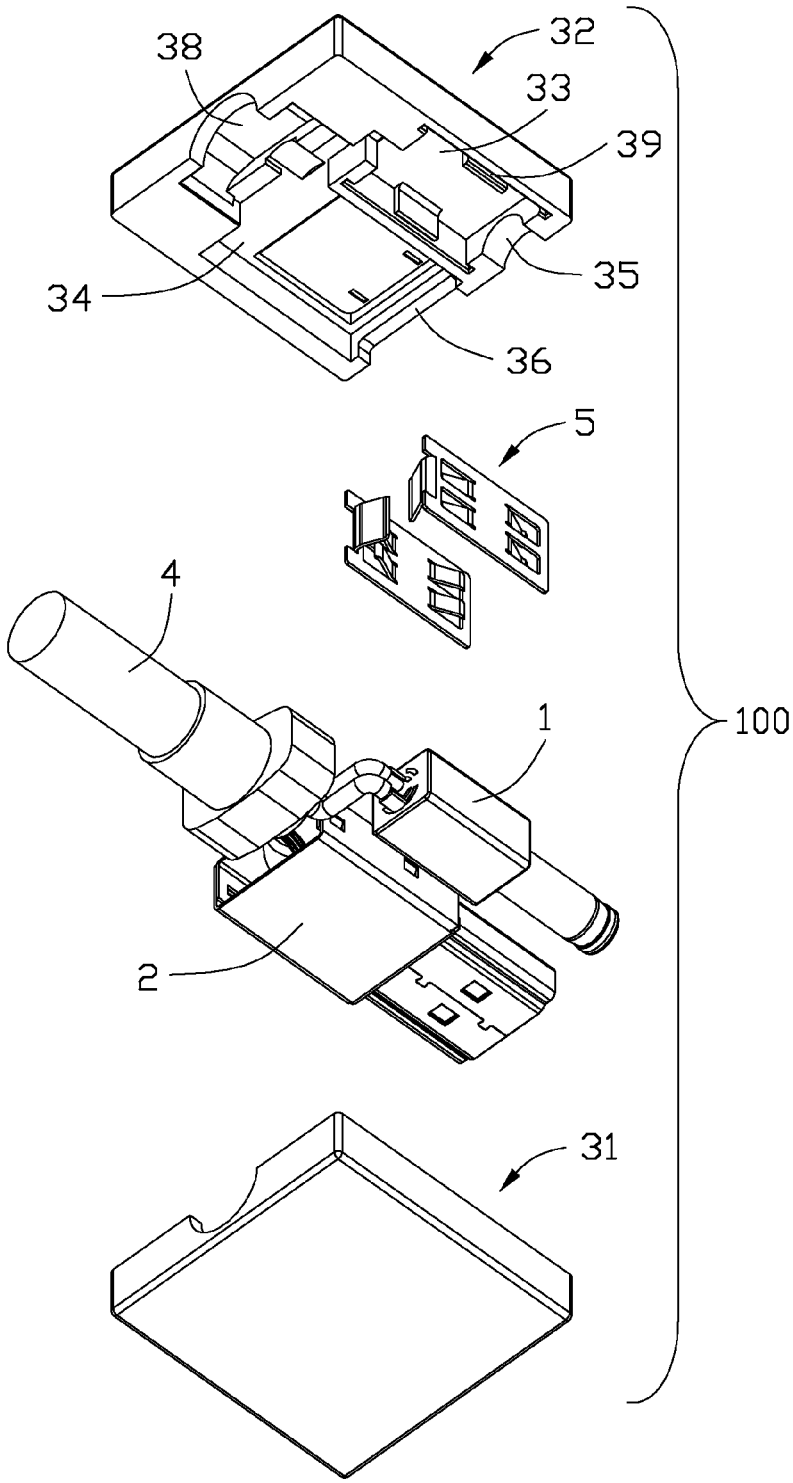
FIG. 5 is another view of the cable assembly as shown in FIG. 4 taken from another view.

Please referring to FIG. 2, FIG. 4 and FIG. 6, the second connector 2 is a fiber connector which includes an insulative housing 21, a contact module 22 assembled to the insulative housing 21, a fiber module 23 assembled to the insulative housing 21, a pair of locking terminals 24 for locking a second mating connector(not shown) and a shield shell 25. The insulative housing 21 comprises a base section 211 and a tongue portion 212 extending forwardly from the base section 211. The base section 211 defines a receiving cavity 216 for receiving the contact module 22 and a pair of retaining grooves 213 located in two sides of the receiving cavity 216. The tongue portion 212 further comprises a depressing portion 214 for receiving the fiber module 23 and a slit 215 extending through the insulative housing 21 to positioning a fiber wire 41 of the cable 4. The contact module 22 comprises a plurality of contacting portions 221 and a plurality of connecting portions 222 located in a back of the contact module 22 to connect the cable 4. The second connector 2 further comprises a positioning member 26 for positioning the fiber module 23 on the insulative housing 21. The shield shell 25 includes a first shell 251 surrounding the tongue portion 212 and a second shell 252 locking with the base section 211 to positioning the contact module 22. The base section 211 and the second shell 252 are assembled together to form a second body 28. The tongue portion 212, the contacting portions 221 of the contact module 22, the fiber module 23 and the first shell 251 together form a second mating portion 29 protruding beyond the second connector 2.

Please referring FIGS. 4-8, the housing shroud 3 includes a first housing shroud 31 and a second housing shroud 32 approximately same as the first housing shroud 31, which are fixed together along an up-to-down direction. The first housing shroud 31 is located under the second housing shroud 32, and both comprise a first receiving slot 33 and a second receiving slot 34 for receiving the first body 11 and the second body 28 respectively. A first recess 35 depresses from a front wall of the first housing shroud 31 for receiving the first mating portion 12. A second recess 36 depresses on a front wall of the second housing shroud 32 for receiving the second mating portion 29. An opening 38 is formed between the first and the second housing shroud 31,32 for positioning the cable 4 at a rear end of the housing shroud 3. The first receiving slot 33 and the second receiving slot 34 are arranged separately along the transverse direction. The first housing shroud 31 further comprises two positioning slots 39 located at two side of the first receiving slot 33, the positioning slot 39 extending along the front-to-back direction and communicating with first receiving slot 33. Two ports are defined by the two first recesses 35 and the two second recesses 36 to receiving the first mating portion 12 and the second mating portion 29 respectively as the first housing shroud 31 and the second housing shroud 32 are assembled together along the up-to-down direction. A size of the port formed by the two first recesses 35 is larger than a size of the first mating portion 12, such that, a gap 30 is formed between an inner wall of the first recess 35 and an outside wall of the first mating portion 12 to make the first mating portion be floatable in the gap 30. The gap 30 is about 0.3 mm.

Please referring to FIGS. 2-8, the cable assembly further comprises a resilient member 5 retained in the two positioning slots 39. In this embodiment, the resilient member 5 includes a pair of resilient pieces. In other embodiments, the resilient member 5 could be a spring. The resilient member 5 extend along the front-to-back direction and engage with the first body 11 to make the first connector 1 be floatable along the transverse direction. The resilient member 5 comprises a pair of positioning blades 51 positioned in the positioning slots 39, a first engaging slice 52 protruding forwardly to the first connector 1 to engage with the two side of the first body 11 to make the first connector 1 float along a transverse direction, and a second engaging slice 53 bent forwardly from a rear edge of the positioning blade 51 and engaging with the back end of the first body 11 to allow the first connector 1 to float along the front-to-back direction.

In assembly, firstly, the cable 4, the first connector 1 and the second connector 2 are assembled separately, then the first connector 1, the second connector 2 and the cable 4 are all retained to the first housing shroud 31, the first body 11 is received in the first receiving slot 33 of the first housing shroud 31, the back end of the first mating portion 12 is received in the first recess 33 and a gap 30 is formed between the outside of the first mating portion 12 and the inner wall of the first recess 35, the second body 28 of the second connector 2 is received in the second receiving slot 34, the second mating portion 29 is positioned in the second recess 36 and can not move. Then, the resilient member 5 is assembled to the positioning slot 39 of the first housing shroud 31, the positioning blade 51 is positioned in the positioning slot 39, the first engaging slices 52 engage with the two sides of the first body 11, the second engaging slices 53 abut against the back end of the first body 11. At last, the second housing shroud 32 covers over the first housing shroud 31, the first connector 1 is moveably set between the first and the second housing shroud 31,32. The second connector 2 is clamped steadily between the first and the second housing shroud 31,32. A distance from the front face of the first mating portion 12 to a front face of the housing shroud 3 is shorter than a front face of the second mating portion 29 to the front face of the housing shroud 3. By this arrangement, the second mating portion 29 can mate with a second mating connector (not shown) first, then, the first mating portion 12 can adjust and mate with the first mating connector precisely according to a distance between the first mating connector and the second mating connector.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable assembly comprising: a first connector; a second connector; a housing shroud positioning the first connector and the second connector therein, the first connector being floatable in virtue of a gap being defined between the housing shroud and the first connector; a cable connecting with rear ends of the first and the second connectors and extending beyond the housing shroud; and at least one resilient member retained beside the first connector and elastically urging the first connector;

wherein the cable assembly comprises two said resilient members arranged in two opposite sides of the first connector along a transverse direction, the housing shroud has two positioning slots located in two sides of the first receiving slot to receive the resilient members;

wherein the resilient member is a resilient piece received in the positioning slot, the resilient member has a positioning vertical blade positioned in the positioning slot and a first engaging slice extending forwardly from the positioning blade to engage with the first connector;

wherein the resilient piece further comprises a second engaging slice extending forwardly from a back end of the positioning blade and forwardly pushing the first connector to make the connector float along a front to back direction.

2. The cable assembly as claimed in claim 1, wherein the first connector is a power plug connector, the second connector is a fiber connector for transferring optical signals and electrical signals.

3. The cable assembly as claimed in claim 1, wherein the positioning slot communicates with the first receiving slot along the transverse direction, the resilient member engages with the first connector along the transverse direction to make the first connector being floatable along the transverse direction.

4. The cable assembly as claimed in claim 2, wherein the first connector comprises a first body received in the first receiving slot and a first mating portion protruding beyond the housing shroud to mate with a first mating connector, the housing shroud defines a first recess depressing on a front end of the first mating portion, the gap is formed between the first mating portion and an inner wall of the first recess along the transverse direction.

5. The cable assembly as claimed in claim 4, wherein the gap is about 0.3 mm.

6. The cable assembly as claimed in claim 4, wherein the second connector comprises a second body received in the second receiving slot and a second mating portion protruding beyond the housing shroud, a first distance from a front end of the first mating portion to a front of the housing shroud is different from a second distance from a front end of the second mating portion to the front end of the housing shroud.

7. The cable assembly as claimed in claim 6, wherein the first distance is shorter than the second distance.

8. A cable assembly comprising: a first connector; a second connector; a housing shroud positioning the first connector and the second connector; a cable connecting with rear ends of the first and the second connectors; and at least a resilient member, wherein the first connector is moveably set in the housing along a direction vertical to a insertion direction of a mating connector, while the second connector being unmoveably set in the housing shroud, said at least one resilient member urges the first connector and unmoveably restore an original position of the first connector;

wherein the cable assembly comprises two said resilient members arranged in two opposite sides of the first connector along a transverse direction, the housing shroud has two positioning slots located in two sides of the first receiving slot to receive the resilient members;

wherein the resilient member is a resilient piece received in the positioning slot, the resilient member has a positioning vertical blade positioned in the positioning slot and a first engaging slice extending forwardly from the positioning blade to engage with the first connector;

wherein the resilient piece further comprises a second engaging slice extending forwardly from a back end of the positioning blade and forwardly pushing the first connector to make the connector float along a front to back direction.

9. The cable assembly as claimed in claim 8 wherein the first connector comprises a first mating portion, while the second connector comprises a second mating portion, both the first mating portion and the second mating portion extend forwardly and beyond a front face of the housing shroud.

10. The cable assembly as claimed in claim 9, wherein the first mating portion is formed in a column shape.

11. The cable assembly as claimed in claim 9, wherein the first connector is a power plug connector, and the second connector is a fiber connector for transferring optical signals and electrical signals.

12. An electrical connector assembly comprising:

a first electrical connector and a second electrical connector side by side arranged with each other in a lengthwise direction with a distance therebetween; and at least one of said first electrical connector and said second electrical connector being equipped with a spring device constantly urging said at least one of said first electrical connector and said second electrical connector to be moveable in a floating manner perpendicular to a mating direction of said at least one of said first electrical connector and said second electrical connector, said mating direction being perpendicular to said lengthwise direction; wherein a housing shroud encloses both said first electrical connector, said second electrical connector, and said spring device;

wherein both said first electrical connector and said second electrical connector are connected to a same cable;

wherein said floating manner further refers to along the mating direction;

wherein said spring device provides a floating effect with regard to the at least one of said first electrical connector and said second electrical connector in the lengthwise direction;

wherein said at least one of the first electrical connector and said second electrical connector defines a cylindrical mating port and a rectangular mounting port which the spring device urges to be in said floating manner.

13. The electrical connector assembly as claimed in claim 12, wherein said at least one of the first electrical connector and said second electrical connector defines a cylindrical mating port.

* * * * *